United States Patent [19]

Smock et al.

[11] 4,381,430

[45] Apr. 26, 1983

[54] COIN OPERATED TIMING MECHANISM

[75] Inventors: Steven W. Smock, Indianapolis; George W. Adams, Greenwood, both of Ind.

[73] Assignee: Emhart Industries, Inc., Indianapolis, Ind.

[21] Appl. No.: 301,720

[22] Filed: Sep. 14, 1981

Related U.S. Application Data

[63] Continuation of Ser. No. 174,498, Aug. 1, 1980, abandoned.

[51] Int. Cl.[3] ..... H01H 43/02

[52] U.S. Cl. ..... 200/35 R; 200/38 R; 200/DIG. 3

[58] Field of Search ..... 200/35 R, 38, 293, 35, 200/DIG. 3; 194/9 R, 9 T, DIG. 17, DIG. 18

[56] References Cited

U.S. PATENT DOCUMENTS

| | | | |
|---|---|---|---|
| 3,114,443 | 12/1963 | New | 194/9 R X |
| 3,237,466 | 3/1966 | Purtilo | 194/9 T |
| 3,417,211 | 12/1968 | Wiser | 200/38R |
| 3,462,565 | 8/1969 | Hall | 200/35 R |
| 3,626,117 | 12/1971 | Stafford | 200/38 F |
| 3,732,383 | 5/1973 | Voland et al. | 200/38 R |
| 3,819,886 | 6/1974 | Homan et al. | 200/38 B |

*Primary Examiner*—J. R. Scott

*Attorney, Agent, or Firm*—Robert F. Meyer; David W. Gomes

[57] ABSTRACT

Upon insertion of a coin into a receiver of a timing mechanism, an actuator rotates a ratchet which in turn rotates a cam. The cam and a disc each have a tab extending therefrom. When the ratchet and cam are rotated, the tabs separate from each other providing a desired timing cycle and the cam is set to close electrical switches. When the timer is operative, the disc rotates causing its tab to engage the tab of the cam to rotate the cam and open the electrical switches.

3 Claims, 6 Drawing Figures

COIN OPERATED TIMING MECHANISM

This application is a continuation, of application Ser. No. 06/174,498, filed Aug. 1, 1980 now abandoned.

BACKGROUND OF THE INVENTION

Generally speaking, the present invention relates to an improvement in coin operated controllers wherein insertion of coins into a receiving means associated with a controller causes a motor drive means to drive cam means to open and close electrical switches associated therewith, one improvement comprising an auxiliary timing means providing a means to vary timing cycles of the cam means.

Another improvement to such a controller is characterized by a means providing extended cycles of the controller which comprises at least one cam having a plurality of lobes, a rotating member, first coupling means coupling the rotating member to the motor drive means, and a second coupling means selectively coupling the rotating member with the cam.

The present invention pertains to a controller and particularly to controllers that are coin operated.

Coin operated appliances are well known in the appliance industry as used in coin operated laundries. The coin receiving apparatus is usually associated with controllers which controls the functions of the particular appliance. Inserting sufficient coins into the receiving apparatus puts the controller in an operable position so that, for example, in a clothes dryer, when the door to the appliance is closed the controller begins to operate to control the electrical functions of the clothes dryer.

One of the problems associated with these types of mechanisms is that of changing the cycles of the controller as the market price of coin operated laundries varies. More specifically, the owner of the laundry in many instances is forced to acquire new controllers in order to provide different timing cycles to meet a competitor's price for drying a load of clothes.

Another problem associated with such mechanisms is in providing a means for the user to extend the length of any given cycle of the controller by the user of the appliance inserting more coins. In such prior art devices, however, the length of time that could be acquired was severely limited.

OBJECTS OR FEATURES OF THE INVENTION

It is, therefore, a feature of the invention to provide a controller operating from a coin receiving apparatus which is relatively simple in construction and easy to manufacture. Another feature of the invention is the provision of such a controller having a means to vary the time of individual cycles. Another feature of the invention is the provision of such a controller having a first timing mechanism and a separate timing means provides the means for varying the cycles. Another feature of the invention is to provide a dual gear as a means to vary the cycles. Still another feature of the invention is the provision of such a controller wherein the separate timing means is controlled by a separate motor which is responsive to a program provided by a cam of the first timing mechanism. Yet another feature of the invention is to provide a means for a user to extend the length of cycles by inserting more coins. Another feature of the invention is to provide such a controller wherein the length of the cycles are extended through a coupling means selectively coupling a driving means to a cam of the controller. These and other features of the invention will become apparent from the following description taken in conjunction with the accompanying drawings.

DETAILED DESCRIPTION OF THE INVENTION

Figure 1:
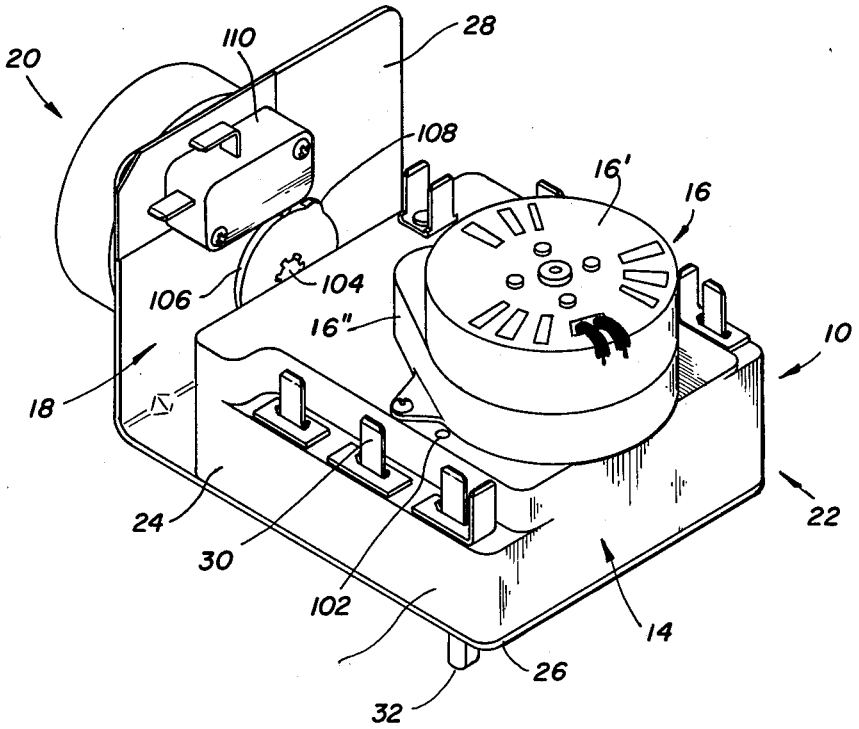
FIG. 1 is an isometric view of a controller employing the features of the invention.
Figure 2:
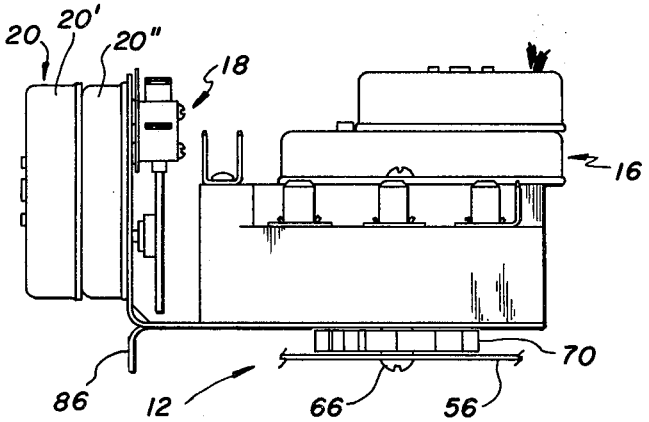
FIG. 2 is a side view of the controller.

Referring to FIGS. 1 and 2, there is shown a coin operated controller 10 which in general includes a preconditioning means 12, a timing mechanism 14 which is driven by a motor drive means 16, and an auxiliary timing means 18 which is driven by a motor drive means 20. Timing mechanism 14 is carried in a housing 22 which includes a cup shaped member 24 that is carried on a base plate 26. Cup shaped member 24 carries motor drive means 16. As shown, base plate 26 extends beyond cup shaped member 24 and is bent at a right angle to provide a plate 28 which carries auxiliary timing means 18 and motor drive means 20. A plurality of electrical terminals 30 as well as a cam carrying shaft 32 extend from inside housing 22. Both motor drive means 16 and 20 include combinations of synchronous motor 16′ and 20′ coupled to speed reducing gear trains 16″ and 20″ respectively.

Figures 3, 6:
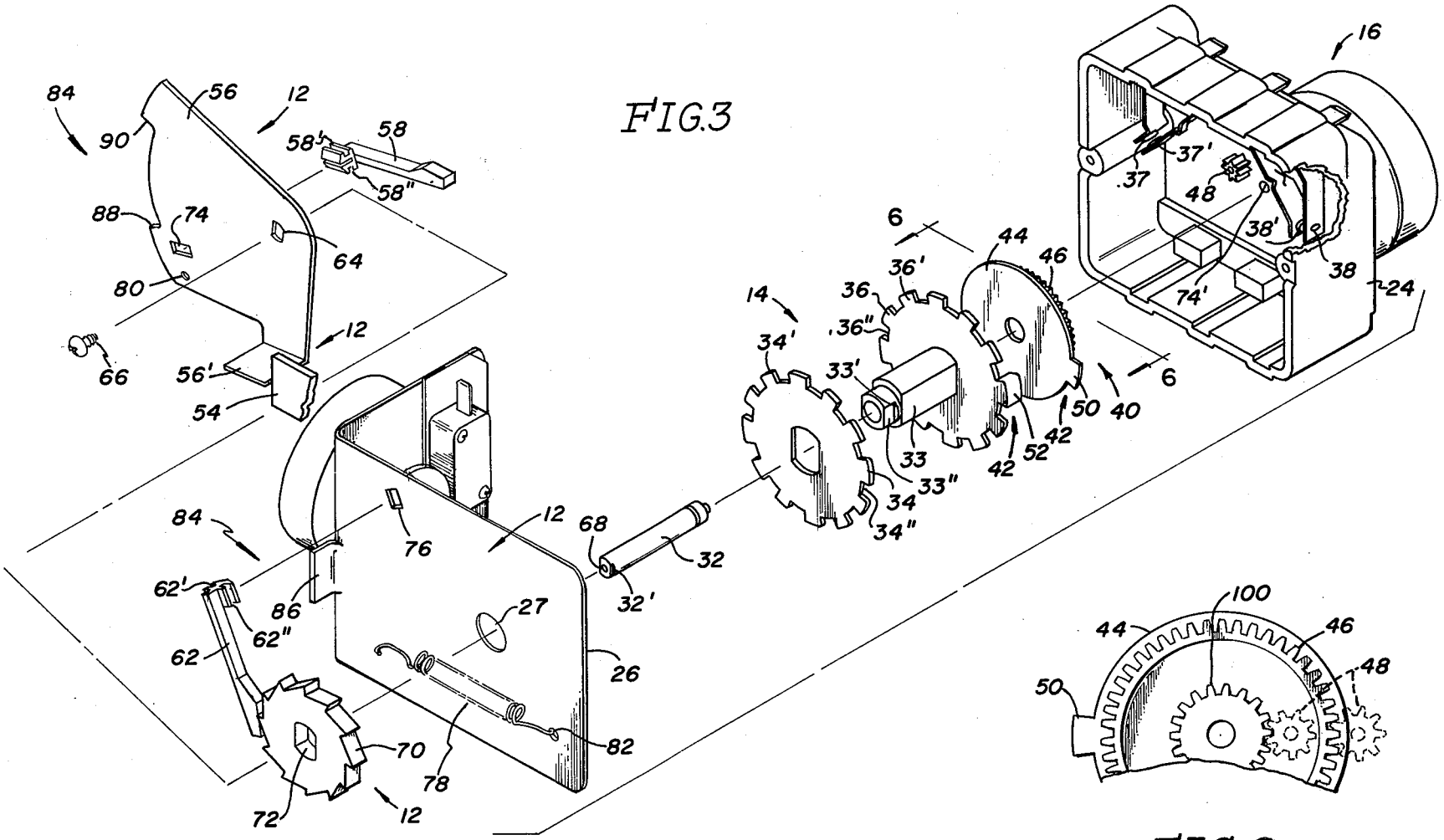
FIG. 3 is an exploded view of the controller.
FIG. 6 is a view taken along the line 6—6 of FIG. 3.

Referring now to FIG. 3, timing mechanism 14 includes a pair of cams 34 and 36 which are fixedly carried on double D shaft 33, electrical switches 37 and 38 that engage the cams and coupling means 40 and 42 coupling the cam to motor drive means 16. Double D shaft 33 is rotatably journalled in end plate 26 through collar 33′ and aperture 27 and rotates about shaft 32 which is journalled in cup shaped member 24 through aperture 24′ and which extends through aperture 27. Coupling means 40 includes a circular disc 44 that is rotatably carried on shaft 32 and which is unitarily constructed with a gear 46 that meshes with output pinion 48 of the gear train of motor drive means 16. Coupling means 42 includes a tab 50 which extends from the outer periphery of disc 44 and engages a tab 52 which extends from an outer periphery of cam 36. Rotation of output pinion 48 causes rotation of gear 46 to cause rotation of disc 44. Engagement of tab 50 with tab 52 causes rotation of both cams 34 and 36 through double D shaft 33.

Figure 4:
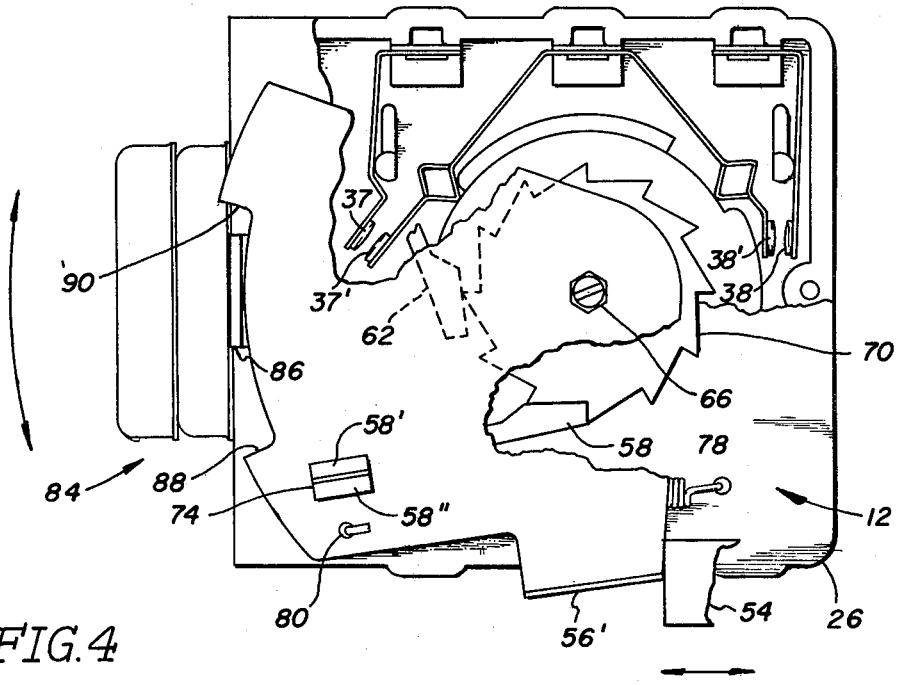
FIGS. 4 and 5 are similar partial sections illustrating different operating modes of the controller.
Figure 5:
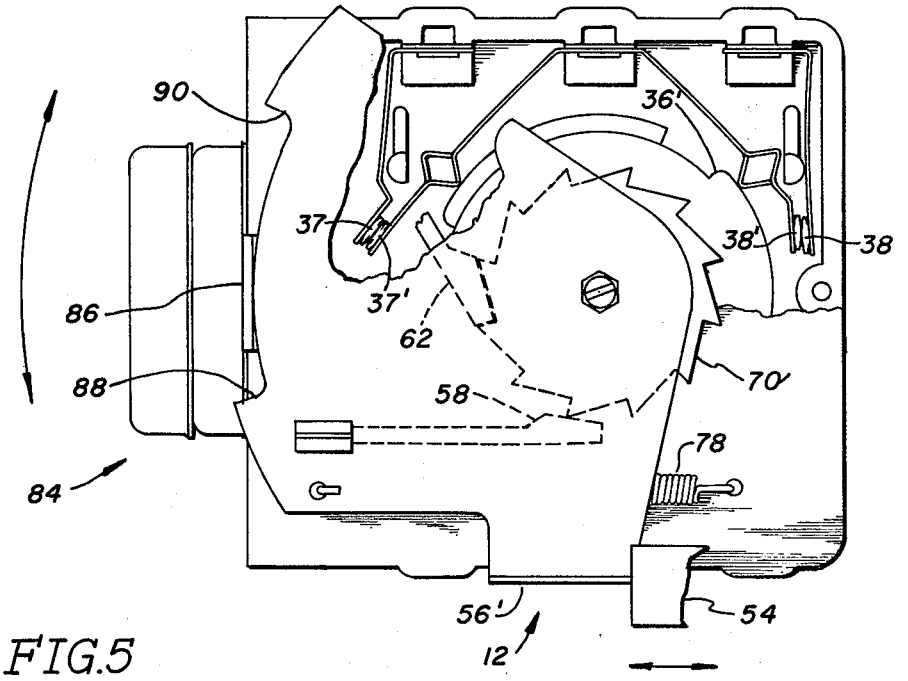

Referring to FIGS. 3–5, the timing mechanism 14 is put in an operational mode through preconditioning means 12 which includes coin slide 54 which receives coins, pivotal actuator 56, drive pawl 58, ratchet 70 and stop pawl 62. Actuator 56 is pivotally mounted on the outside face of base plate 26 on the double D portion 32′ of shaft 32 through double D aperture 64 in actuator 56 so as to be rotatable with the shaft. A screw 66 further holds the actuator in place through engagement with threaded hole 68 in the shaft. Ratchet 70 is mounted outside base plate 26 between the base plate and actuator 56 on double D portion 33″ through double D aperture 72 to be rotatable with the shaft portion 33. Drive pawl 58 is rigidly mounted on actuator plate 56 through slots 58′ and 58″ engaging the sides of aperture 74 while stop pawl 62 is rigidly mounted on base plate 26 through slots 62′ and 62″ engaging the sides of aperture 76. The actuator plate 56 is spring biased through a coil spring 78 which is held between aperture 80 of the actuator and aperture 82 of base plate 26. A stop means 84 limits the travel of the actuator and includes a tab 86 which is carried between ears 88 and 90 of the actuator. Engagement of the tab with either of the ears limits its travel.

The arrangement of the preconditioning means 12 and coupling means 40 and 42 permits the operator of the appliance to lengthen the amount of time it is in operation in accordance with the number of times the coin slide 54 is actuated which depends on the amount of coins inserted. As an example of the controller's operation, assume that it is being used in a coin operated clothes dryer. A coin is inserted in coin slide 54 and the slide pushed toward actuator 56 to engage it with tang 56′. This causes the actuator to pivot clockwise and permit drive pawl 58 to slip over the teeth of ratchet 70 (FIG. 5) until the pawl slips into and engages a tooth of the ratchet (FIG. 4). Upon release of the slide 54, actuator 56 returns to its original position through spring 78 forcing drive pawl 58 to advance the ratchet one step to rotate shaft portion 33 and advance or rotate cams 34 and 36 until movable blades 37′ and 38′ engage the outer peripheries 34′ and 36′ respectively of cams 34 and 36 to close switches 37 and 38. Timing mechanism 14 is now ready for operation with electrical circuits being established to motor drive means and the switches. When the door to the dryer is shut, electrical power is applied to motor drive means 16 and the closed switches provides power to the dryer motor (switch 37) and the dryer heater (switch 38). Motor drive means 16 rotates disc 44 through motor output pinion 48 and gear 46. Cams 34 and 36 remain stationary until such time as the rotation of disc 44 causes tab 50 to engage tab 52 to rotate the cams until the movable blades drop into a notch of the cams to open the switches. Power to the dryer motor and heater as well as motor drive means 16 is then shut off.

The spacing between the teeth of ratchet 70 are synchronized with the outer peripheries 34′, 36′ and notches 34″, 36″ so that with each inserting of a coin and release of the slider, cams 34 and 36 rotate a step sufficient to place the movable blades 37′ and 38′ at an outer periphery. As more coins are fed, each successive outer periphery will be engaged and more importantly, in accordance with one of the features of the invention, longer cycle times are provided. More specifically, with each successive turn of the cams, the separation between the tabs 50 and 52 becomes greater so that it takes a longer period of time for the tabs 50 to catch up to and engage tab 52 and move the cams 34 and 36 so as to drop the movable blades 37′ and 38′ into a notch to open the electrical circuits and complete the cycle.

One of the advantages of the arrangement just described is that the next operator of the appliance does not have to reset the controller back to a zero or start position.

In accordance with another feature of the invention, an owner of the coin operated appliance is able to adjust individual cycles without replacing the cams of the timing mechanism. With the present controller, this can be done by either one of two means or a combination of both means may be used. Referring to FIG. 6, one of the means includes a second gear 100 carried within and concentric with gear 46 and which can be engaged by motor output pinion 48 by merely removing the complete motor drive means 16 and locating it in a different position on cup shaped member 24. For example, the complete unit could be turned around and secured in a pair of oppositely disposed holes 102 (FIG. 1, one hole shown).

The other means of changing the individual timing cycles is provided by auxiliary timing means 18. Auxiliary timing means 18 includes motor drive means 20 having an output shaft (FIG. 1) that carries a cam 106 having a cam lobe 108 that actuates a microswitch 110 as the cam is rotated by the motor drive means. The microswitch is electrically connected to and provides an electrical pulse to motor drive means 16 so as to rotate member 44 (FIG. 3) in a pulsing mode through gear 46. Since the gear is being pulsed it takes a longer period of time for tab 50 to catch up to and engage tab 52 to thereby lengthen the timing cycle of cams 34 and 36. The pulse rate can be varied in accordance with the selected configuration of cam 106. Such selection can be very easily made by the owner since the cam is merely fitted over the output shaft 104 of motor drive means 20.

What is claimed is:

1. In a coin operated controller wherein insertion of at least one coin into a receiving means associated with a timing mechanism causes a motor drive means to drive cam means to open and close electrical switches associated therewith, an improvement characterized in a means providing extended cycles for said timing mechanism comprising:

(a) a drive shaft, (b) at least one cam fixedly carried on said drive shaft and having a plurality of lobes providing a cam outer periphery and notches therein, (c) at least one electrical switch biased in an open position when engaging said outer periphery and biased in a closed position when engaging said notices, (d) a ratchet fixedly carried on said drive shaft and including teeth synchronized with said lobes, and actuator means engaging said ratchet and rotating same a predetermined amount upon an insertion of a coin in said receiving means, (e) a rotating means rotatably carried on said drive shaft and a gear carried on said rotating member and coupled to said motor drive means, and (f) a tab extending radially from a periphery of said rotating member and a cooperating tab extending from a face of said cam means near its periphery, insertion of a coin causing rotation of said ratchet and said cam means and displacing said tabs with respect to each other.

2. In a coin operated controller wherein insertion of at least one coin into a receiving means associated with a timing mechanism causes a motor drive means to drive cam means to open and close electrical switches associated therewith, an improvement characterized in a means providing extended cycles for said timing mechanism comprising:

(a) a drive shaft, (b) at least one cam fixedly carried on said drive shaft and having a plurality of lobes providing a cam outer periphery and notches therein, (c) at least one electrical switch biased in an open position when engaging said outer periphery and biased in a closed position when engaging said notches, (d) a ratchet fixedly carried on said drive shaft and including teeth synchronized with said lobes, and actuator means engaging said ratchet and rotating same a predetermined amount upon an insertion of a coin in said receiving means, (e) a rotating member rotatably carried on said drive shaft and a gear carried on said rotating member and coupled to said motor drive means, and (f) a tab carried by said cam means and a tab carried by said rotating member, insertion of a coin causing rotation of said ratchet and said cam means and separating said tab of said cam means from said tab of said rotating member, and motor driven rotation of said rotating member causing its tab to engage said tab of said cam means and rotate same.

3. In a controller according to claim 2 wherein a tab extends radially from a periphery of said rotating member and a tab extends from a face of said cam near its periphery.

* * * * *